United States Patent [19]

Laurencelle

[11] Patent Number: 5,035,073

[45] Date of Patent: Jul. 30, 1991

[54] DIRECTORY DEVICE AND METHOD OF OPERATION

[76] Inventor: Robert Laurencelle, 498 Parker Ave., South Meriden, Conn. 06450

[21] Appl. No.: 460,241

[22] Filed: Jan. 2, 1990

[51] Int. Cl.[5] ..... G09F 7/00

[52] U.S. Cl. ..... 40/585; 40/611; 40/618

[58] Field of Search ..... 40/489, 490, 491, 585, 40/611, 618

[56] References Cited

U.S. PATENT DOCUMENTS

| | | | |
|---|---|---|---|
| 664,843 | 6/1901 | Epple | 40/585 |
| 890,925 | 6/1908 | Rand | 40/489 |
| 1,079,179 | 11/1913 | Kinney | 40/611 |
| 1,096,767 | 5/1914 | Tompkins | 40/585 |
| 1,123,215 | 1/1915 | Anthony | 40/585 |
| 1,970,822 | 8/1934 | Sommers | 40/585 |
| 3,418,738 | 12/1968 | Goodman | 40/618 |
| 3,419,978 | 1/1969 | Ostrand | 40/585 |
| 3,531,884 | 10/1970 | Adler | 40/618 |
| 3,685,186 | 8/1972 | Goodman | 40/618 |

FOREIGN PATENT DOCUMENTS

| | | | |
|---|---|---|---|
| 5150 | of 1906 | United Kingdom | 40/611 |

*Primary Examiner*—Gary L. Smith
*Assistant Examiner*—F. Saether
*Attorney, Agent, or Firm*—Bachman & LaPointe

[57] ABSTRACT

A secure directory device for displaying information on removable plates. The device includes a special key for removing and replacing plates, thereby precluding unauthorized tampering.

9 Claims, 4 Drawing Sheets

8

DIRECTORY DEVICE AND METHOD OF OPERATION

BACKGROUND OF THE INVENTION

The present invention relates to directory devices and relates in particular to such devices in which a plurality of removable plates bearing information or other indicia are supported in a frame where the frame is fixed to a permanent support such as a flat surface or wall.

A typical prior art directory device is disclosed and described in U.S. Pat. No. 4,523,402, issued June 18, 1985, to Charles E. Dobson.

In the '402 patent a series of parallel, transversely disposed plates 18 are secured to vertical mounting bars 32 by means of attaching strips 10 which are, in turn, secured to mounting bars 32 by screws 37.

In directory devices of the class to which this invention pertains, it is important that the overall unit present a pleasing, neat and esthetically appropriate appearance.

Most importantly, the directory should be secure against unauthorized tampering or vandalism while incorporating a convenient means for changing or replacing individual information carrying plates.

When the plates show names of individuals or business operations quartered in a large building, normal "turnover" requires that the directory be adjusted to reflect the occurrence of new arrivals or the departure of old occupants.

It is important that these changes be made conveniently, quickly and with little or no risk of damage to the esthetic nature of the directory.

SUMMARY OF THE INVENTION

Consequently it is a prime feature of the present invention to provide a directory device which presents a good appearance, is secure against unauthorized tampering and can be adjusted readily to effect changes in the information displayed.

A further feature of the invention is the provision of removable information plates which are supported in a simple frame where the plates are interlocked directly with frame members preventing unauthorized removal.

A still further feature of the invention is the provision of a concealed structural configuration in the plates which cooperates with a key means facilitating easy removal of individual plates.

A further feature of the invention is the provision of overall directory design which facilitates easy insertion of plates.

Unique to this system is that the plates may be constructed of materials of different texture or composition, such as plastic, brass, stainless steel, wood or stone, accenting and blending with the texture or decor of the surrounding elements of a building or structure.

A still further feature of the invention is the provision of a double or multiple frame structure supporting two or more sets of plates.

A directory device embracing certain principles of the present invention may comprise a frame means including a pair of opposed generally vertical members, at least one transversely disposed movable plate making an interlocking connection with said vertical members, resilient means disposed within one of said vertical members in contact with said plate for stressing said plate, compressively urging said plate toward the other vertical member, and a key reception means formed in one end portion of said plate for receiving a key means whereby operation of said key means is effective to move the plate in opposition to said resilient means to free the plate from said vertical members and from said frame.

A method embracing certain other principles of the invention practiced in removing plates from a directory device of the type described above may comprise the steps of providing a key reception means in said plate which is susceptible of concealment, inserting manually a key means into the reception means, manipulating said key means to move said plate in opposition to said resilient means, whereby a portion of said plate is free of said interlock, and utilizing the key means to lift said plate free of said frame means.

Other features and advantages of the invention will become more apparent from an examination of the succeeding specification when read in conjunction with the appended drawings, in which;

DETAILED DESCRIPTION OF THE INVENTION

Figure 1:
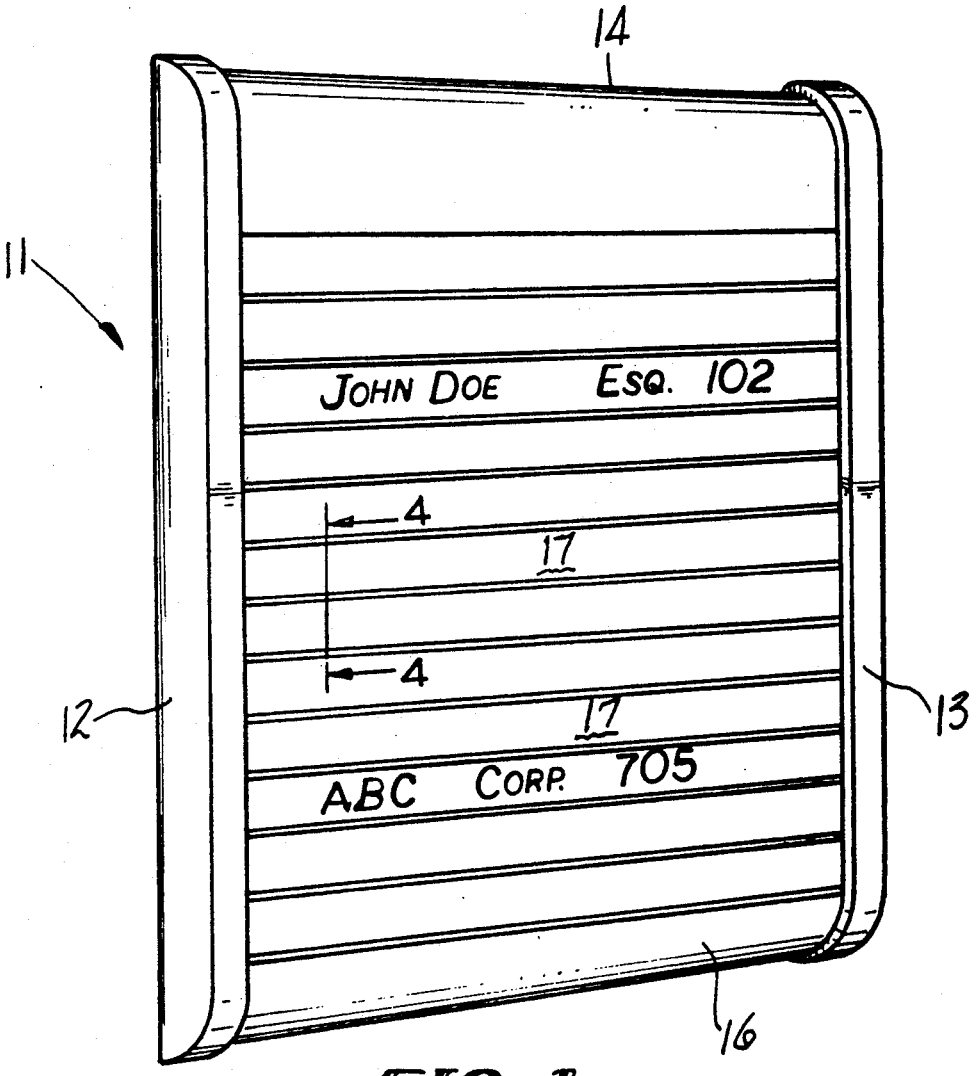
FIG. 1 is a perspective view of a directory device of the present invention.
Figure 4:
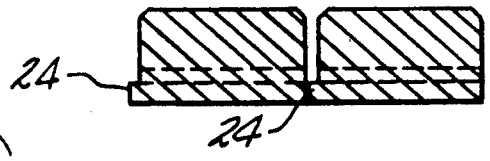
FIG. 4 is a sectional view of a portion of FIG. 1 showing a lip on the plates providing access for a key means.

Referring to FIGS. 1, 2, 3 and 4, the reference numeral 11 designates a directory device having a frame defining vertical members 12 and 13 and horizontal members 14 and 16 supporting a plurality of indicia bearing plates 17.

Figure 3:
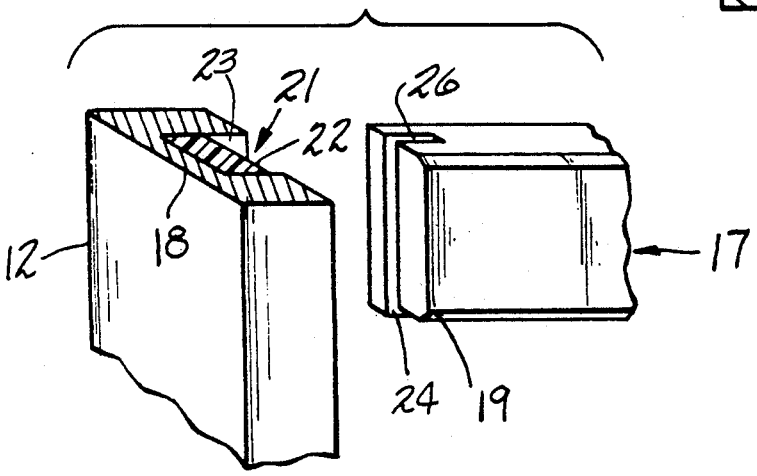
FIG. 3 is a fragmentary view showing the interlocking connection between the vertical frame members and the ends of the indicia plates.
Figure 2:
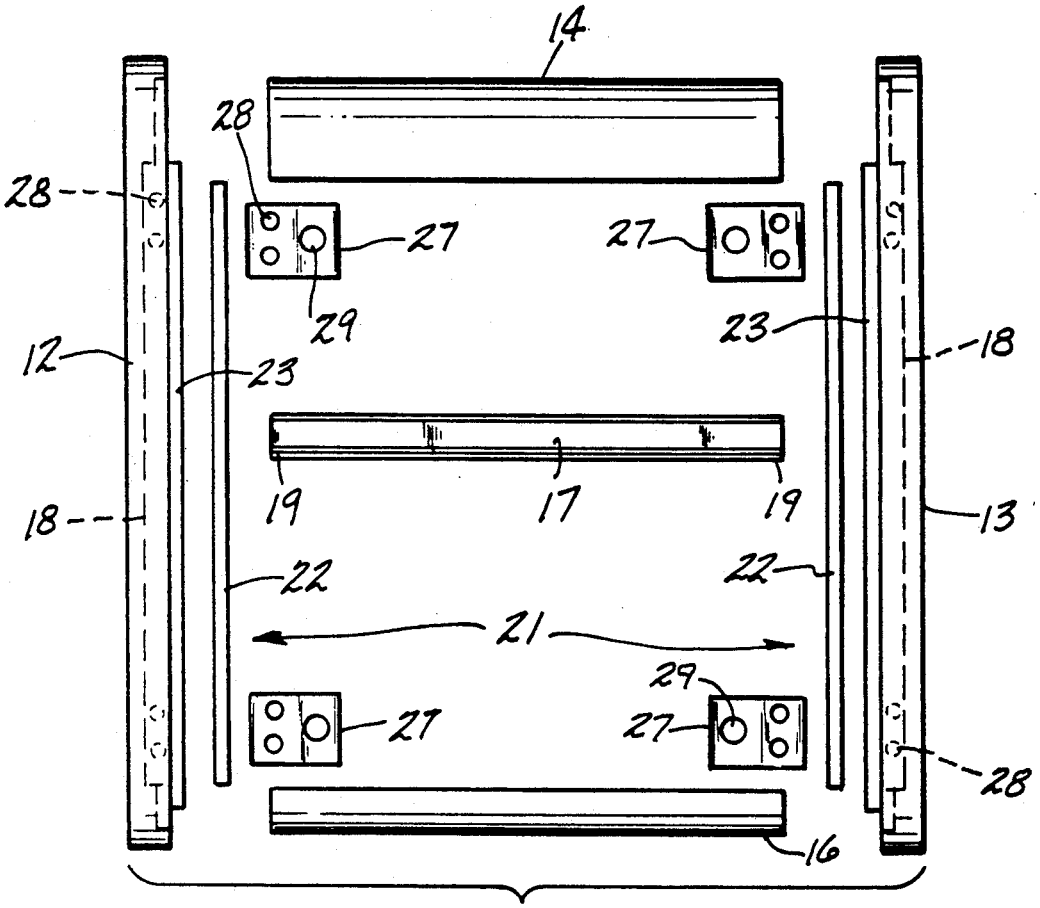
FIG. 2 is an exploded view of the device of FIG. 1.

As is most apparent in FIGS. 2 and 3, the vertical members 12 and 13 include a recess 18, making an interlocking connection with end portions 19 of plates 17 received therein.

Disposed between the end portions 19 of plates 17 is a resilient means 21, which in the present embodiment is an elongated, resilient pad 22 fabricated of foamed or cellular synthetic material.

Figure 6:
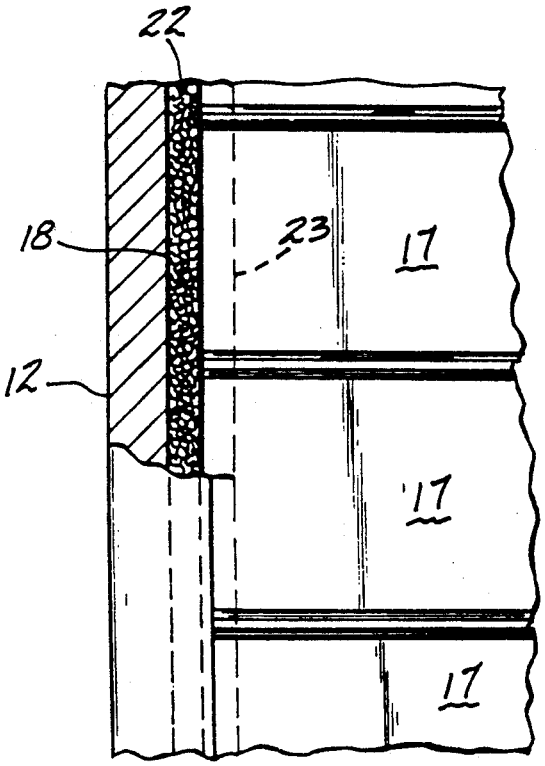
FIG. 6 is a fragmentary view showing the location of the resilient means.
Figure 5:
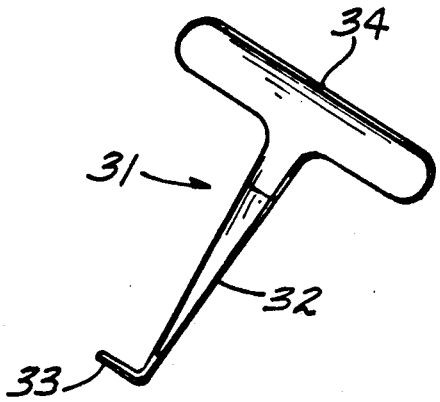
FIG. 5 is a perspective view of a key means.

If desired, a lip 23 may be secured or otherwise fabricated to the vertical members 12 and 13, to provide a stop aligned with the inner margin of the recess 18 against which the plates bear, as is most apparent in FIGS. 3 and 6.

This lip 23 provides a stop or seat useful for alignment when inserting a plate into the frame, as will become more apparent as this specification proceeds.

The individual plates 17 are formed with a bead or spacer 24 to provide clearance for a key means between plates.

Note further that at least one end portion of a plate is formed with a key reception means defining a slot 26 which is concealed entirely when the plates are assembled in the frame.

Clips 27, (FIG. 2), used to secure the frame 11 to a plane surface such as a building wall, include suitable holes for securing the clips to the frame as at 28 and to the wall as at 29.

Referring to FIG. 5, and 7–10, the steps practiced in removing and replacing individual plates are shown.

A key means 31 having a shank 32 terminating at one end in a hook 33 and at the opposite end in a handle 34, is inserted between adjacent plates (spaced by beads 24) with the hook 33 projecting to the right toward vertical member 13.

Figure 7:
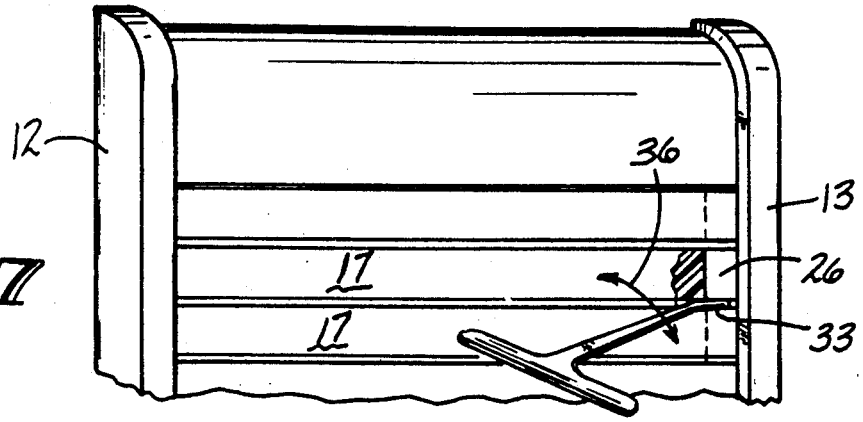
FIGS. 7, 8, 9 and 10 show the steps in operating the key means to remove a plate.

When the key is inserted, the hook 33 bottoms on a bead 24 (see FIG. 4) and is poised to enter a slot 26 of either plate 17 of FIG. 7. Thereafter the key is rotated clockwise or counterclockwise (as indicated by arrow 36) to enter a slot depending upon which plate one wishes to remove.

Figure 8:
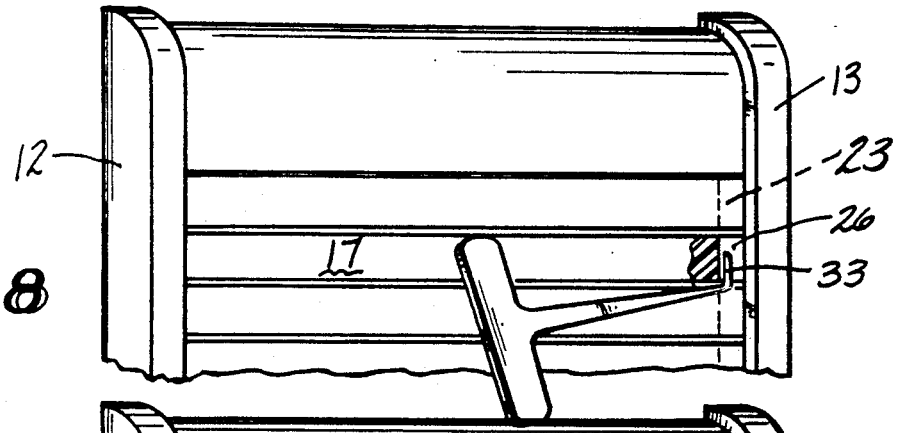
Figure 9:
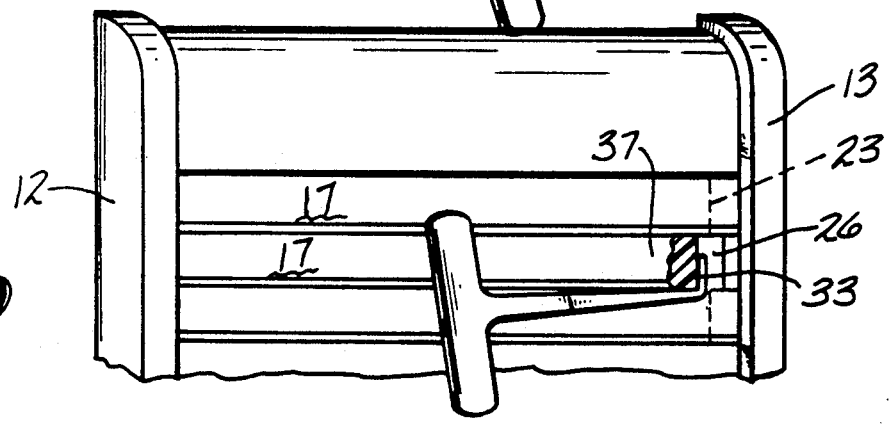

For example, rotation of the key counterclockwise as shown in FIG. 8 causes the hook 33 to enter slot 26 of plate 17.

After the hook 33 enters the slot 26 one drops the key handle 34 (toward the plane of the face of directory device) to the position of FIG. 8, and pulls upon the handle 34 to the left (FIG. 9) to move the plate 17 to the left against the resilient means 21 at the opposite end of the plate to unlock the end portion 37 from the recess 18 of vertical member 13, as shown.

Thereafter one uses the key 31 to lift the end portion 37 free of the frame whereupon one can grasp the plate removing it completely from the frame.

Figure 10:
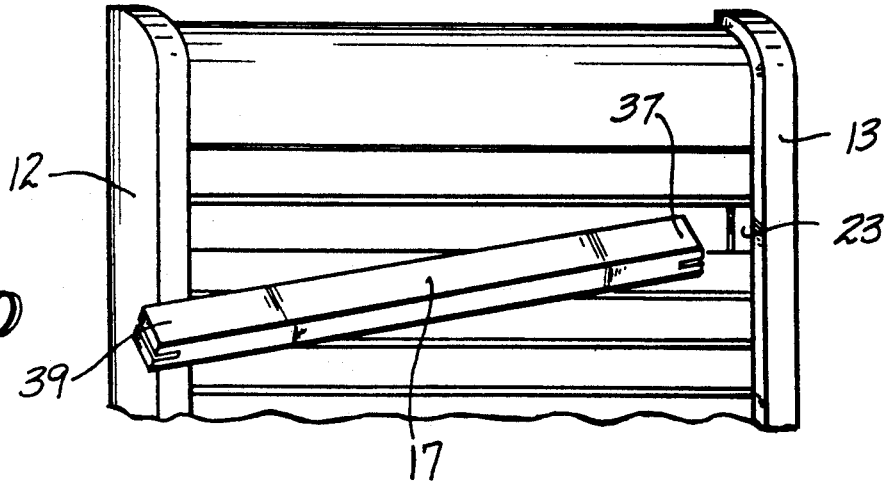

FIG. 10 shows that to replace a plate 17, one merely has to insert the end portion 37 of plate 17 into the recess 18 of member 13 guided by lip 23.

As stated earlier, it is possible to insert end portion 37 without the guidance of lip 23.

Upon pressing the plate 17 to the right (FIG. 10) against its resilient pad 22, (not shown), the opposite end 39 of the plate is free to drop into the corresponding recess 18 in vertical member 12.

The resilient pad of vertical member 13 casts the plate 17 to the left to complete the interlock between the plate 17 and the opposed vertical members 12 and 13.

If desired, resilient pads 22 may be provided in each recess 18 to equalize stress upon the plates.

In embodiments of the invention which include the lip 23, one can appreciate that the existence of the lip facilitates entry of the end portions of the plates 17 in that the lip 23 represents a seat or stop precluding pushing the end portion 18 too deeply and overriding the recess 18.

Figure 11:
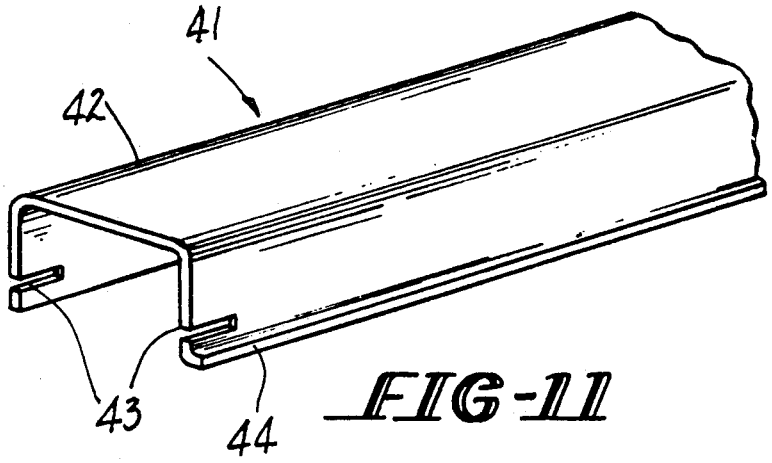
FIG. 11 shows an alternative metallic plate structure.

FIG. 11 shows an alternative plate structure 41 defining a hollow metallic channel or extrusion 42 having key slots 43 and spacer bead 44.

The plate 41 is inserted and removed by the key 31 in the same fashion as described with respect to the plates 17.

Figure 12:
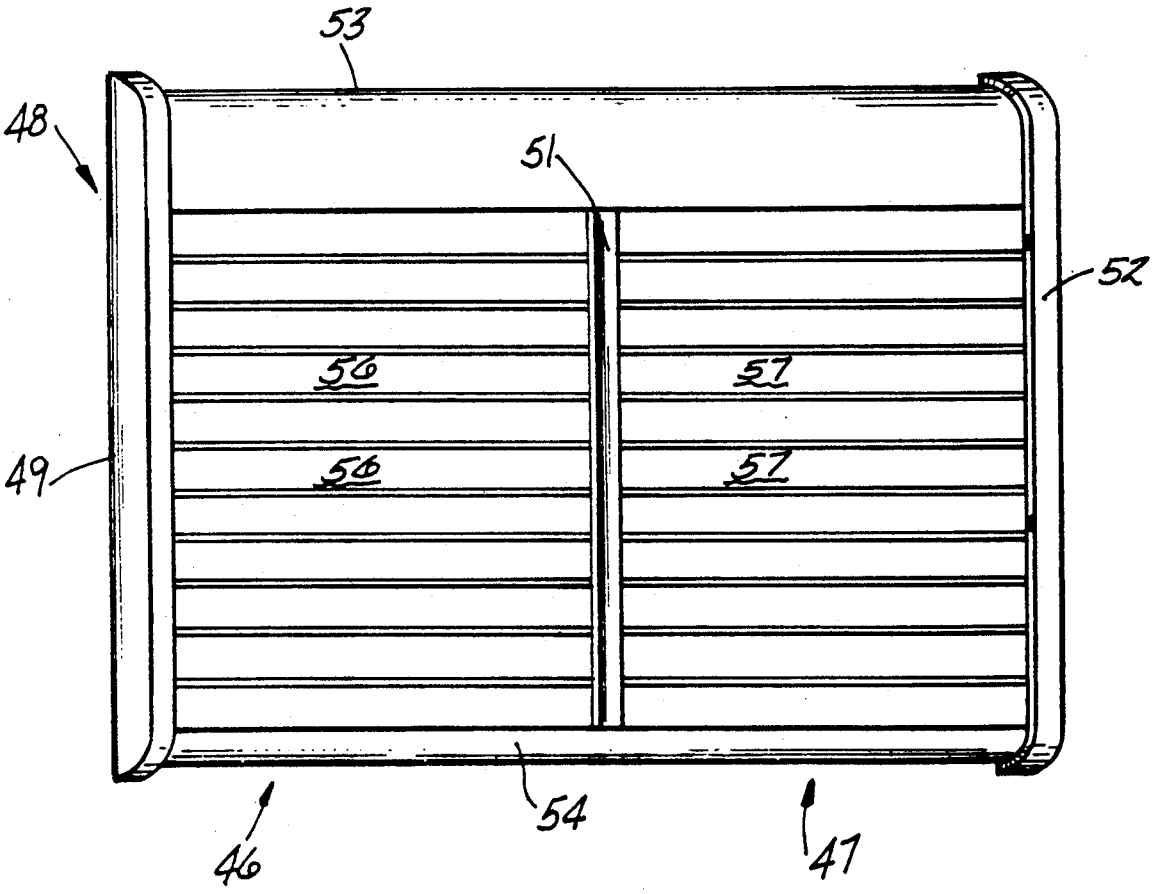
FIG. 12 is a front elevation showing a double set of indicia plates.

FIG. 12 shows a double frame structure supporting two sets of plates 46 (first plates) and 47 (second plates). In this arrangement, the frame means 48 includes first, second and third vertical members 49, 51 and 52, respectively, joined by spaced horizontal members 53 and 54.

The vertical members 49, 51 and 52 are formed with recesses, (not shown), such as the recess 18 so as to receive end portions of plates 56 and 57.

The recess 18 of at least one vertical member of a pair of vertical members, such as 49 and 51, must include a resilient means. Correspondingly, the recess 18 of one vertical member of the pair 51 and 52 must also include a resilient means to facilitate the insertion and removal of plates 56 and 57 in the manner described previously.

Obviously, a directory device may comprise numerous sets of plates beyond a pair as shown in FIG. 12 and a single plate may be used in contrast to a plurality of plates.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A vandal proof directory device having a front side for displaying information comprising:

an open frame means including a pair of opposed, spaced generally vertical members and a pair of opposed, spaced generally horizontal members, a plurality of transversely disposed movable plates on which said information is carried making an interlocking connection with said vertical members, resilient means disposed in at least one of said vertical members in contact with one end portion of said plates for stressing said plates compressively, a key reception means formed in said plates for receiving a key means, operation of said key means is effective to move each of said plates against said resilient means to free said opposite end portion of the plate from the other of said vertical members to remove said plate from said frame, said key reception means defining a concealed slot, each of said plates being formed further with a bead means extending along a side thereof, said bead means having a surface which is coplanar with a surface of said slot, said bead means surface defining a stop means cooperating with said key means for locating said key means relative to said slot, said bead means further defining a spacer for providing access between said plates for insertion of said key means from said front side so that when said key means bottoms on said stop means the key means is rotatable to enter a slot of one of said plates.

2. The device of claim 1 in which each plate in combination with said bead means consists of a single, seamless piecepart.

3. A key means in combination with the direction device of claim 1, said key mans defining a hook operable to bottom on said bead means, said key means further defining a handle operable to rotate said key means after bottoming on said bead means whereby said hook enters one of said slots.

4. The device of claim 1 in which the key reception means of one plate is disposed opposite the key reception means of an adjacent plate.

5. The device of claim 4 in which key reception means is formed in an end portion of said plate opposite said one end portion.

6. In a vandal proof directory device wherein a plurality of indicia bearing, movable plates are disposed horizontally, side by side and removably within a frame means under compressive stress generated by a resilient means incorporated into the frame means;

a method of removing the plates individually from a front side comprising the steps of:

concealing a key reception means in each of said plates, spacing said plates vertically, inserting manually a key means into a space between adjacent plates, rotating said key means into engagement with the key reception means of one of said plates, using said engaged key means to move said one plate in opposition to said resilient means to free an end portion of said plate from said frame means, and;

utilizing the key means to lift said end portion free of said frame means whereby the plate is removed from said frame.

7. The method of claim 6 wherein the key reception means defines a slot formed in an end portion of each plate and the key means includes a hook operable to be received in the slot whereby the key is further operable to move a plate laterally and lift an end portion of a plate.

8. The device of claim 1 wherein the frame means includes first, second and third vertical frame members; the first and second frame members making an interlocking connection with a first plate and the second and third frame members making an interlocking connection with a second plate, and the resilient means cooperating with the first plate is disposed in one of said first and second vertical frame members and the resilient means cooperating with the second plate is disposed in one of said second and third vertical frame members.

9. The device of claim 1 wherein the frame means includes a pair of spaced, opposed generally horizontal members and the horizontal members, said plate and the vertical members are all fabricated of metallic material.

* * * * *